US005879542A

United States Patent [19]

Hoecker

[11] Patent Number: 5,879,542

[45] Date of Patent: Mar. 9, 1999

[54] FLOTATION PROCESS

[75] Inventor: Walter Hoecker, Subiaco, Australia

[73] Assignee: Commonwealth Industrial Gases Limited, Chatswood, Australia

[21] Appl. No.: 611,832

[22] Filed: Mar. 6, 1996

Related U.S. Application Data

[63] Continuation of Ser. No. 199,469, Feb. 22, 1994, abandoned.

[30] Foreign Application Priority Data

Feb. 23, 1993 [AU] Australia ..... PL7461

[51] Int. Cl.[6] ..... B03D 1/06; B03D 1/02; B03D 1/002

[52] U.S. Cl. ..... 209/167; 209/166

[58] Field of Search ..... 209/166, 167; 252/61

[56] References Cited

U.S. PATENT DOCUMENTS

| | | |
|---|---|---|
| 1,728,352 | 9/1929 | Lowe . |
| 1,869,532 | 8/1932 | Weinig . |
| 1,893,517 | 1/1933 | Gaudin . |
| 1,973,558 | 9/1934 | Brinker . |
| 2,012,830 | 8/1935 | Rolston . |
| 3,137,649 | 6/1964 | DeBenedictis . |
| 5,068,028 | 11/1991 | Miller et al. . |
| 5,110,455 | 5/1992 | Huch . |

FOREIGN PATENT DOCUMENTS

| | | |
|---|---|---|
| 56-141856 | 11/1981 | Japan . |

OTHER PUBLICATIONS

"The Separation by Flotation by Copper–Lead–Zinc Sulfides" Wills, B.A. Mining Magazine Jan. 1984 pp. 36–41.

*Primary Examiner*—Thomas M. Lithgow
*Attorney, Agent, or Firm*—David A. Draegert; Salvatore P. Pace

[57] ABSTRACT

Disclosed is a process for the flotation of a mineral concentrate comprising the steps of forming an aqueous slurry of a milled mineral ore containing particles of a desired mineral species and adding a flotation reagent which causes a desired variation in the flotation tendency of the desired mineral species present within the slurry so as to increase the efficiency of separation of that mineral species from the slurry relative to a situation where said flotation reagent is absent from the slurry. A stabilising agent is introduced to the slurry in an amount which creates electrochemical conditions conductive to separation of the desired mineral from the slurry and causes the destruction of a deleterious component from the slurry which consumes the flotation reagent thereby maintaining or improving the efficiency of separation of the desired mineral species from the slurry of milled ore.

7 Claims, No Drawings

FLOTATION PROCESS

This is a continuation of application Ser. No. 08/199,469 filed Feb. 22, 1994, now abandoned.

FIELD OF THE INVENTION

The present invention relates to flotation processes and, in particular, to processes requiring activation or depression of species present in a milled ore concentrate.

BACKGROUND OF THE INVENTION

Flotation is a widely utilised unit operation in mineral processing and is based upon the principle that different mineral species have different wetting characteristics. This difference in wetting characteristic can be used as a basis for separating the different mineral species of a milled ore because relatively unwetted or hydrophobic milled mineral particles adhere more strongly to a stream of gas bubbles, generally air, passing through a slurry of the milled mineral than those particles which are relatively wetted or hydrophilic.

The process is generally assisted by the addition of reagents, for example, depressants which reduce the flotation tendency of certain minerals such as pyrite and activators such as copper sulphate which activate, that is, assist minerals to float which do not have a tendency to do so even in the presence of collectors. Organic collectors such as sodium ethyl xanthate which enhance the tendency of mineral particles to adhere to bubbles of gas are also widely utilised.

The flotation operation is conducted in flotation cells and columns which contain a slurry of the milled ore to be separated into the constituent streams of concentrate and gangue. A gas, usually air, is sparged through the cell or column causing hydrophobic particles to selectively attach to air bubbles, generally with the aid of agents such as those described above. The hydrophobic particles collect in a froth layer at the top of the cell and are removed. The unfloated material is removed from the bottom of the cell from where it may be transferred to a further flotation stage in which the flotation conditions may be altered to selectively float the same or another desired mineral concentrate. Alternatively, the unfloated materials may be removed as a tails or gangue stream which may be used to fill desired mine shafts or for other forms of land reclamation.

A typical flotation process involves the separation of the constituents of a mixed ore such as an ore containing the minerals galena (lead sulphide), sphalerite (ZnS) and pyrite ($FeS_2$). In a first stage, galena is floated by adding a xanthate collector (0.05–0.15 kg $t^{-1}$ ore) to promote the flotation of galena. Sodium cyanide and zinc sulphate (0.05–0.15 kg $t^{-1}$ ore and 0.5–1 kg $t^{-1}$ ore respectively) are added to depress the pyrite and sphalerite. In a second stage, sphalerite is activated with copper sulfate to form a copper sulfide layer on the sphalerite grains which allows adsorption of the xanthate activator and flotation of a predominately zinc concentrate. Pyrite is recovered as a tailing.

Where the ore is more complex or the proportion of coarse particles is too high, regrinding and further flotation circuits may be required. Cleaner and scavenger flotation cells may also be required to maximise recovery of desirable mineral constituents. It is also to be noted that effective flotation requires careful control over chemical conditions such as pH which require an acid or lime to be added in conditioning stages prior to each flotation step.

In spite of the above precautions, the tails stream from a flotation circuit often contains appreciable amounts of valuable minerals and therefore, if the flotation operation is to be optimised in terms of economic efficiency, these minerals must be reclaimed to the maximum extent possible. Such an objective requires careful control over the flotation process both through judicious use of the above described agent, control over pH, Eh, and, consequently, the process chemistry. It will be appreciated, in this regard, that the above described agent are expensive and over use is to be discouraged.

A problem arises with certain minerals of economic importance, for example sphalerite (zinc sulphide), pyrite (iron (III) sulphide), arsenopyrite (iron arsenosulphide) and stibnite ($Sb_2S_3$) in that such minerals have a poor tendency to float even in the presence of collectors. In these instances, it has been necessary to employ an activator such as copper sulphate to encourage flotation. The copper sulphate achieves this objective by encouraging the formation of a surface layer(s) of copper sulfide, a mineral which does have a tendency to float. In the case of sphalerite, the formation of this surface layer follows the chemical reaction.

$$ZnS+Cu^{2+} \rightarrow CuS+Sn^{2+} \quad (I)$$

Unfortunately, it has been found that copper sulphate must often be used in excess of the theoretical quantity required to enable the formation of sufficient coverage of the zinc sulfide with copper sulfide. As the operation is conducted at alkaline pH there is a tendency for hydroxylated copper species to form which may also react with other species such as cyanide and complex sulphated anions causing the activation process to become less efficient. Similar behaviour may be observed with other milled ones.

SUMMARY OF THE INVENTION

Therefore, it would be of advantage to the mineral processing industry to provide a flotation process which enables the flotation reagent, for example, an activator to be used to best effect, that is, by reducing the species responsible for preventing (or deactivating) activation and ideally, simultaneously creating a conducive chemical environment for flotation. Therefore, the object of the present invention is to maximise the benefit of such reagents.

With this object in view the present invention provides a process for the flotation of a mineral concentrate comprising the steps of:

(a) forming an aqueous slurry of a milled ore containing a desired mineral;

(b) adding a flotation reagent which causes a desired variation in the flotation tendency of the desired mineral present within the slurry to obtain at least partial separation of the mineral from the slurry; and (c) adding a stabilising agent to the slurry in an amount which creates electro chemical conditions conducive to separation of the mineral from the slurry and causes destruction of a deteterious component in the slurry which is chemically reactive with and consumes said flotation reagent to reduce separation of the desired mineral from the slurry.

Advantageously, the desired mineral is a sulfide mineral contained within a milled sulphide ore.

Conveniently, the flotation reagent may be soluble in the aqueous phase of the slurry being, for example, an activator such as copper sulphate or a depressant such as sodium or potassium cyanide and other depressants containing hydroxyl, sulphite or sulphide radicals.

The stabilising agent may be, for example, an oxidising agent such as permanganate and peroxide or an oxidising gas containing elemental or molecular oxygen with the proviso that the oxidising agent is not exclusively air where the oxidising agent is added to the flotation cell. Oxidising gaseous agents, such as oxygen, may be found to be especially suitable but species such as ozone and oxidising gases and mixtures of such gases may also be of benefit.

The deleterious component to be destroyed can either exist in dissolved form within the aqueous phase of the slurry or on the surfaces of the mineral grains. Destruction involves removal by dissociation or either mechanism which involves loss of integrity of the deleterious component.

In the specification and the claims, "destruction" demands the removal of the component from the slurry by chemical reaction or other means. In this regard, metallic components are not destroyed, they merely remain in a metallic state or in a different oxidation state. Such variation in oxidation state does not, of itself, constitute destruction.

Conveniently, the stabilising agent is also inert with respect to the desired flotation reagent, though situations may be envisaged where the stabilising agent reacts with the flotation reagent to form a flotation reagent of acceptable or greater performance with respect to separation efficiency. By "inert" is indicated that reaction of flotation reagent and stabilising agent does not proceed to an extent where separation efficiency is economically hindered with respect to the situation where the stabilising agent is absent from the slurry.

Advantageously, the presence of stabilizing agent in the slurry should be conductive to the creation of chemical conditions favourable to flotation. In particular, where an oxidising gas is used, this will be conducive to the creation of optimal electrochemical conditions for flotation through its influence over the oxidation potential ($E_h$) of the slurry. One aspect of the invention is predicated on the basis that careful control over $E_h$ creates flotation conditions conducive to high separation efficiency and to the destruction of oxygen consuming deleterious components which become unstable in an oxidising environment. As an example may be mentioned sulphur containing anions such as the complex sulphide anions which form when sulphide minerals are exposed to an alkaline environment. Such sulphide anions, being oxygen consuming species, can be converted by oxidation to the thio sulphate radicals and ultimately the divalent sulphate anion which does not consume flotation reagents with consequential decline in separation efficiency. If such species are allowed to remain in the slurry, the activation is particularly affected, since hydroxylated copper species not amendable to adsorption of collectors form. In the case of a separation involving zinc, formation of hydroxylated copper species cause an inevitable consequential fall in grade and recovery of the zinc concentrate.

Conveniently, the slurry containing the milled mineral ore is treated with the oxidising agent prior to entry of the slurry to the flotation cell, preferably in a conditioning stage. The adjustment of pH during the conditioning stage should preferably be such as to obtain an alkaline environment which causes depression of pyrite and therefore is more conducive to separation of sulphide minerals.

DETAILED DESCRIPTION OF THE INVENTION

The invention will be better understood from the following description of a preferred embodiment thereof, made with reference to the following examples.

EXAMPLE 1

FLOTATION OF A ZINC CONCENTRATE FROM A LEAD/ZINC ORE

In this example, a milled lead/zinc sulphide ore was subjected to a flotation process to separate the lead and depress zinc and gangue(pyrite). The tailings from this separation was subjected to a further flotation process incorporating the addition of pure oxygen gas to the flotation cell. Oxygen was supplied by sparging gas through the flotation cell at rates of 1 liter/minute and 5 liters/minute for periods of 65 minutes, 80 minutes and 90 minutes respectively and the results compared with the situation using a conventional flotation method to enable separation of lead and zinc sulphides. The oxidation potential of slurry in the flotation cell was also measured upon attainment of rest potential and the results tabulated below.

| | $O_2$ at 1 l/minute | | $O_2$ at 5 l/minute | |
|---|---|---|---|---|
| Standard Method | | t = 65 minutes | t = 80 min | t = 90 min |
| Oxidation Potential (mV) | 3.7 | 151 | 87 | 144 |
| Grade (% by weight zinc) | 46.43 | 46.96 | 50.24 | 47.27 |
| Recovery (% zinc from milled ore) | 56.61 | 75.83 | 67.01 | 66.81 |

The addition of oxygen at lower flowrates may or may not be effective depending on the oxygen uptake rate of the milled ore which in the case of the above ore varies between 0.4 and 3.0 mg/l/min, a very high oxygen demand ore. This uptake rate must be satisfied before the benefits of oxygenation are gained, the uptake rate is therefore an important parameter in the residence times selected for oxygenation and the oxygen supplied to the flotation cell.

It is to be noted that the feature of higher oxidation potential reflects a decrease in the presence of reactive sulphides which interfere with flotation processes as described above.

The oxidation of pyrite causes the pH of the slurry to fall during the above flotation process so it is important to add sufficient quantities of an alkaline agent such as lime to the slurry during flotation or, where the above operation is undertaken during conditioning, during conditioning to maintain pH in the range 10.5–11.5 where separation efficiency is optimal.

EXAMPLE 2

FLOTATION OF A ZINC CONCENTRATE FROM A LEAD/ZINC ORE 120 tph of a tailings stream as described with reference to Example 1 and having a solids density of 40% and analyzing 0.4% Cu, 0.9% Pb and 13.38% Zn was fed to the zinc separation stage of the concentrator and subjected to a flotation process in five stages involving the addition of 16 $m^3$/hr oxygen (10 $m^3$/hr of this oxygen being supplied in the form of air) to conditioning cells, pH was maintained in the alkaline range by the addition of sufficient lime to maintain pH at 11.0. The results are tabulated below. Comparative results for standard running without oxygen are included for comparison. With the exception of oxygen/air addition, the flotation process is conventional.

Zinc Grade and Recovery.

| Stage | Standard Zinc Recovery (%) | Standard Zinc Grade (%) | Oxygen Addition Zinc Recovery (%) | Oxygen Addition Zinc Grade (%) |
|---|---|---|---|---|
| 1 | 55.35 | 52.00 | 65.46 | 52.60 |
| 2 | 70.22 | 50.68 | 79.82 | 51.71 |
| 3 | 88.85 | 47.10 | 93.26 | 45.97 |
| 4 | 93.09 | 44.25 | 96.37 | 41.44 |
| 5 | 94.62 | 42.14 | 97.35 | 39.01 |

Zinc recovery was appreciably higher at acceptable grade, the degree of improved recovery having substantial economic value on an annualised basis.

EXAMPLE 3

FLOTATION OF A ZINC CONCENTRATE FROM A LEAD/ZINC ORE

Plant conditions are the same as Example 2, with throughput 14.0 $m^3$/hr oxygen being supplied to the conditioning cells as air, rather than as described above.

Zinc Grade and Recovery.

| Stage | Standard Zinc Recovery (%) | Standard Zinc Grade (%) | Oxygen Addition Zinc Recovery (%) | Oxygen Addition Zinc Grade (%) |
|---|---|---|---|---|
| 1 | 68.80 | 54.40 | 68.76 | 54.40 |
| 2 | 80.05 | 52.19 | 81.87 | 52.77 |
| 3 | 93.25 | 47.52 | 94.39 | 46.92 |
| 4 | 95.01 | 43.05 | 95.85 | 42.73 |
| 5 | 95.56 | 40.21 | 96.32 | 40.57 |

Again, as discussed with respect to Example 3, zinc recovery was appreciably higher at acceptable grade.

EXAMPLE 4

FLOTATION OF A ZINC CONCENTRATE FROM A LEAD/ZINC ORE

The plant conditions are as in Example 2.

Zinc Grade and Recovery.

| Stage | Standard Zinc Recovery (%) | Standard Zinc Grade (%) | Oxygen Addition Zinc Recovery (%) | Oxygen Addition Zinc Grade (%) |
|---|---|---|---|---|
| 1 | 55.35 | 52.00 | 65.73 | 52.70 |
| 2 | 70.22 | 50.68 | 80.40 | 51.36 |
| 3 | 88.85 | 47.10 | 92.69 | 44.89 |
| 4 | 93.09 | 44.25 | 95.89 | 40.88 |
| 5 | 94.62 | 42.14 | 97.01 | 38.46 |

Recovery is appreciably higher using oxygen at acceptable grade.

EXAMPLE 5

FLOTATION OF A ZINC CONCENTRATE FROM A LEAD/ZINC ORE

The plant conditions are as in Example 3.

Zinc Grade and Recovery.

| Stage | Standard Zinc Recovery (%) | Standard Zinc Grade (%) | Oxygen Addition Zinc Recovery (%) | Oxygen Addition Zinc Grade (%) |
|---|---|---|---|---|
| 1 | 68.80 | 54.40 | 73.84 | 52.40 |
| 2 | 80.05 | 52.19 | 85.03 | 51.68 |
| 3 | 93.25 | 47.52 | 95.65 | 44.47 |
| 4 | 95.01 | 43.05 | 97.14 | 40.38 |
| 5 | 95.56 | 40.21 | 97.67 | 37.77 |

With respect to design of the flotation and conditioning cells, the present invention is amendable to inclusion within plants containing conventional flotation cells of the Agitair type or other type known to those in the art. Similarly, the method of delivery of reagents, whether of solid or gaseous type, to flotation and conditioning cells is well known to those skilled in the art. Nevertheless, where an oxidising gas is employed, the gas delivery equipment should be such as to ensure high oxygen dissolution. Therefore, equipment which promotes swarming of fine micron-sized bubbles of the gas is to be preferred From this point of view, pressurised delivery of a gas is to be preferred though this is not essential.

It is to be noted that while the foregoing description has focussed on the use of oxygen, being a widely and economically available gas, other gases and oxidants may be used without departing from the scope of the present invention.

I claim:

1. A process for the recovery of a zinc concentrate by flotation comprising the steps of:

(a) forming an aqueous slurry of a milled zinc containing ore containing zinc sulfide which requires activation with copper sulfate to enable substantial flotation thereof;

(b) adding an oxidizing agent selected from the group consisting of oxygen, ozone and mixtures thereof with the proviso that the oxidizing agent is not exclusively air in an amount sufficient to oxidize components of the slurry which are reactive with copper sulfate;

(c) adding copper sulfate to said slurry; and (d) adding a collector and floating said zinc sulfide mineral.

2. The process of claim 1 wherein said oxidizing agent further consists of air.

3. The process of claim 1 wherein said milled zinc containing ore uptakes oxygen, said process further comprising adding the oxidizing agent to the slurry at a rate dependent on the rate the milled zinc containing ore uptakes oxygen.

4. The process of claim 1 wherein the components of the slurry reactive with copper sulfate are soluble in a liquid phase of said slurry.

5. The process of claim 1 where the components of the slurry which are reactive with copper sulfate are surface active and located on grains of said milled zinc containing ore.

6. The process of claim 1 wherein the components of the slurry which are reactive with copper sulfate contain sulfur and oxygen.

7. The process of claim 1 further comprising maintaining the slurry at an alkaline pH.

* * * * *